US010752402B1

(12) United States Patent
Beauregard et al.

(10) Patent No.: US 10,752,402 B1
(45) **Date of Patent: *Aug. 25, 2020**

(54) HYGIENIC WET-ARTICLE HOLDER WITH LIQUID DISPENSER

(71) Applicant: Family Innovators B&F, LLC, Manchester, MA (US)

(72) Inventors: Cynthia Ann Beauregard, Manchester, MA (US); Edward Joseph Beauregard, Manchester, MA (US); Craig Edward Beauregard, Quincy, MA (US); Bethany Marie Fleming, Tewksbury, MA (US); James William Fleming, Tewksbury, MA (US)

(73) Assignee: FAMILY INNOVATORS B&F, LLC, Manchester-By-The-Sea, MA (US)

( * ) Notice: Subject to any disclaimer, the term of this patent is extended or adjusted under 35 U.S.C. 154(b) by 228 days.

This patent is subject to a terminal disclaimer.

(21) Appl. No.: 15/954,914

(22) Filed: Apr. 17, 2018

Related U.S. Application Data

(63) Continuation-in-part of application No. 14/716,223, filed on May 19, 2015, now Pat. No. 9,944,434.

(60) Provisional application No. 62/000,784, filed on May 20, 2014.

(51) Int. Cl.

| | |
|---|---|
| ***B65D 25/04*** | (2006.01) |
| ***B65D 85/00*** | (2006.01) |
| ***B65D 25/38*** | (2006.01) |

(52) U.S. Cl.
CPC ..... *B65D 25/04* (2013.01); *B65D 25/38* (2013.01); *B65D 85/70* (2013.01)

(58) Field of Classification Search
CPC ..... A47K 5/1211; A47K 5/00; A47K 5/12; B65D 25/04; B65D 25/38; B65D 25/08; B65D 81/32; B65D 81/3211; B65D 81/3238; B65D 81/3266
USPC ..... 206/361
See application file for complete search history.

(56) References Cited

U.S. PATENT DOCUMENTS

| | | | |
|---|---|---|---|
| 1,534,259 | A | 4/1925 | Dempsey |
| 2,233,157 | A | 2/1941 | Hermann |
| 3,642,499 | A | 2/1972 | Castell |
| D252,312 | S | 7/1979 | Ackeret |
| 4,275,970 | A | 6/1981 | Morrison et al. |
| D273,652 | S | 5/1984 | Lederman et al. |
| 4,752,147 | A | 6/1988 | Persi |
| 4,793,517 | A | 12/1988 | Washut |
| 4,854,449 | A | 8/1989 | Fitzhugh |

(Continued)

*Primary Examiner* — Anthony D Stashick
*Assistant Examiner* — Lauren Kmet
(74) *Attorney, Agent, or Firm* — BainwoodHuang

(57) ABSTRACT

A technique for containing a wet article includes a top section, a middle section removably attached to the top section, and a bottom section removably attached to the middle section. The top section includes a dispenser and an article holding region. The dispenser forms a normally-closed compartment for holding liquid and has a depressible top. The top section is configured, upon depression of the depressible top, to open a passageway between the dispenser and the article-holding region for allowing liquid to flow from the dispenser to the article-holding region. The middle section includes a funnel having a more open end facing the top section and a less open end facing the bottom section. The funnel is configured to conduct fluid released from the wet article from the top section to the bottom section.

16 Claims, 9 Drawing Sheets

(56) References Cited

U.S. PATENT DOCUMENTS

| | | | |
|---|---|---|---|
| 5,009,327 | A | 4/1991 | Levison |
| 5,085,330 | A | 2/1992 | Paulin |
| 5,575,848 | A | 11/1996 | Chedville |
| 5,871,116 | A | 2/1999 | Picchietti |
| 6,135,307 | A | 10/2000 | Fahy |
| 6,237,880 | B1 | 5/2001 | McNutly |
| D507,939 | S | 8/2005 | Mitchel, Jr. |
| 6,942,412 | B2 | 9/2005 | Gueret |
| D511,642 | S | 11/2005 | Riddell et al. |
| 7,487,881 | B2 | 2/2009 | Watzke et al. |
| 7,597,495 | B2 | 10/2009 | Gueret |
| D613,131 | S | 4/2010 | Chen et al. |
| 7,866,183 | B2 | 1/2011 | Roth et al. |
| 8,016,150 | B1 | 9/2011 | Bunch et al. |
| 8,142,095 | B1 | 3/2012 | Cutler |
| 8,240,503 | B2 | 8/2012 | Curtin |
| 8,485,378 | B2 | 7/2013 | Zoss et al. |
| 8,574,647 | B1 | 11/2013 | Gunderson |
| 8,887,665 | B2 | 11/2014 | Rocker et al. |
| 8,985,377 | B2 | 3/2015 | Lane |
| 9,192,279 | B1 | 11/2015 | Valle et al. |
| 9,440,775 | B2 | 9/2016 | Dwyer et al. |
| 9,717,272 | B2 | 8/2017 | Patel et al. |
| 9,944,434 | B1 * | 4/2018 | Beauregard ..... B65D 25/04 |
| 2005/0199622 | A1 | 9/2005 | Radow |
| 2007/0075268 | A1 | 4/2007 | Harris |
| 2008/0078200 | A1 | 4/2008 | Roth et al. |
| 2009/0194138 | A1 | 8/2009 | Burns |
| 2010/0329924 | A1 | 12/2010 | Harris |
| 2012/0024812 | A1 | 2/2012 | Underwood |
| 2014/0239783 | A1 | 8/2014 | Dordan |
| 2015/0050405 | A1 | 2/2015 | Trager et al. |
| 2016/0066749 | A1 | 3/2016 | Trager et al. |
| 2016/0273789 | A1 | 9/2016 | Gwen |

* cited by examiner

HYGIENIC WET-ARTICLE HOLDER WITH LIQUID DISPENSER

PRIORITY

This application is a continuation-in-part of U.S. application Ser. No. 14/716,223, filed May 19, 2015, which claims priority to U.S. Provisional Patent Application No. 62/000,784, filed May 20, 2014. The contents and teachings of both prior applications are incorporated herein by reference.

TECHNICAL FIELD

This application relates generally to an accessory for any type of bath sponge or wet article.

BACKGROUND

Bath sponges and other wet articles are typically transported for travel and use away from home by consumers in a variety of ways. For example, a conventional approach to transporting a sponge involves using a plastic zip lock bag to transport the sponge. Another conventional approach involves transporting a wet sponge wrapped in a bath towel.

SUMMARY

Unfortunately, there are deficiencies in the above-described conventional approaches to transporting sponges and other potentially wet articles, such as towels, washcloths, bathing suits, gym clothes, socks, and the like. For example, a wet article is not separated from the water and debris that are present after usage. This presents a potentially non-hygienic environment. Along these lines, transporting wet articles in plastic bags allows the articles to remain wet as they sit in soiled water. Such articles may tend to build up bacteria.

In addition, carrying a wet article in this manner can also be a potential leaking hazard if the zip lock bag opens during the transporting process. Further, the water and debris can transfer to other items in a suitcase or gym bag in which the article is carried.

Also, some consumers who store sponges in a bath towel may accidently put their sponges in the washer or dryer as it is hidden in the bath towel. The washing and drying of a bath sponge may result in abrasive or frayed edges making the bath sponge unsuitable for use.

Another issue with bath sponges is that they lose their shape and uniformity over time as they are used. As the bath sponge loses its original shape they become less effective at applying body wash, soap or lotion. This can also create unnecessary wasting of body wash or lotions.

In contrast to the conventional approaches which may give rise to non-hygienic environments, improved techniques of transporting articles involve holding an article in a case that will carry and compress the article. Such a case separates the soiled water and debris that is drained from the article. The case is designed to facilitate the drainage of water and debris that have accumulated in the article after it is used. The action of compressing the article within this case will also help to maintain the original shape of the bath sponge. This case will keep all water and debris that has collected by the action of compression of the bath sponge contained in the lower sections of the case. In addition, when this case is stored in an upright position, the water and debris will not be able to flow back into the top section where the sponge is being stored.

In some arrangements, the case has three parts. A top section of the case will hold and aide in the compression of the article. A middle section will facilitate compression by driving up into the top section. The middle section will also facilitate drainage by diverting liquid and debris to the lower section through a round opening with a funnel design. A bottom section will serve as a base. The base may enclose the case and hold water and debris when the case is placed upright. In a typical application an article would be placed into the top section of the case and can either be hung on a hook in a shower or bathtub by the hanging loop design on the upper part of the case. This action allows the article to be compressed and drain excess water and debris. The action of continuous compression also allows the article to maintain its original shape. When the consumer wants to take a bath sponge or other article with them when traveling or at the gym, the middle and lower sections can be assembled together and attached to the top section by pushing or driving the middle section into the top section and fastening all sections together. Once fully assembled the case can be either hung on the outside of any travel bag by the hanging loop or it can be stored in any carrying case or suitcase. If it is most important for a consumer to have a case made of a precious metal material, the case can be made of this type of material. If use with a smaller sponge or article is most important to a consumer, this case can also be made in a smaller size. The case may be impregnated with an antimicrobial substance to inhibit bacterial growth.

Advantageously, the improved techniques provide a convenient, portable, and hygienic way for consumers to carry and or transport bath sponges and other articles. This case provides a convenient way to carry an article and also provides a hygienic solution by separating the water, bacteria, and debris. This case helps a bath sponge to maintain its original shape and make it more effective for application of body wash, soap, or lotion.

In some arrangements, the top section of the case includes a dispenser region and an article-holding region. The dispenser region forms a normally-closed compartment for holding a liquid, such as liquid soap, bath wash, lotion, shampoo, or the like. The dispenser region has a depressible top which, when pressed down, opens a passageway between the dispenser region and the article-holding region and allows liquid to flow from the dispenser region to the article-holding region. The dispenser region thus enables the case to carry liquid and to keep the liquid separate from the article-holding region until it is desired to apply liquid to an article.

In some examples, the dispenser region has a top surface and a bottom surface. The top surface is deformable, and the bottom surface forms a boundary that separates the dispenser region from the article-holding region. The top surface is coupled to or integral with a plunger. The plunger has a shaft that extends down from the top surface and passes through a clearance hole in the bottom surface, forming a head on a far side of the bottom surface. The head of the plunger normally holds the clearance hole closed, but when the top surface is pressed down relative to the bottom surface, the shaft translates down from the clearance hole, providing a passageway for the liquid to flow from the dispenser region into the article-holding region.

In some examples, the dispenser region includes a closable aperture having an open position and a closed position. When in the open position, the closable aperture provides an opening between the dispenser region and an area outside the case, which enables one to conveniently introduce liquid into the dispenser region. When in the closed position, the closable aperture forms a liquid-tight seal, which is arranged to prevent liquid from leaking through the closable aperture. According to some variants, the closable aperture is implemented with a hole in the dispenser region wherein the hole is selectively covered and uncovered by operation of a hinged door.

In some examples, the bottom surface of the dispenser region is formed from a more rigid material than is the top surface of the dispenser region.

In some examples, the dispenser region and the article-holding region are provided as separate components, which one may attach together to form the top section of the case. In other examples, the top surface and the plunger form a single separable component, and the bottom surface is formed as a ceiling of the article-holding region. The separable component is engaged with the article-holding region and may be retained thereby.

In some examples, the dispenser region includes a hanging loop formed coextensively with the top surface. In other examples, a hanging loop is formed on an outside surface of the article-holding region.

Certain embodiments are directed to a method of containing a wet article. The method includes attaching a top section of a case to a middle section of the case with the wet article placed between the top section and the middle section, such that the wet article is compressed between the top section and the middle section when the top section and the middle section are attached together. The method further includes draining fluid from the wet article through a funnel in the middle section of the case and into a bottom section of the case. The funnel extends inwardly from an external sidewall of the middle section and downwardly toward the bottom section.

Other embodiments are directed to an apparatus for containing a wet article. The apparatus includes a top section, a middle section removably attached to the top section, and a bottom section removably attached to the middle section. The top section includes a dispenser and an article holding region. The dispenser forms a normally-closed compartment for holding liquid and has a depressible top. The top section is configured, upon depression of the depressible top, to open a passageway between the dispenser and the article-holding region for allowing liquid to flow from the dispenser to the article-holding region. The middle section includes a funnel having a more open end facing the top section and a less open end facing the bottom section. The funnel is configured to conduct fluid released from the wet article from the top section to the bottom section.

The foregoing summary is presented for illustrative purposes to assist the reader in readily grasping example features presented herein; however, the foregoing summary is not intended to set forth required elements or to limit embodiments hereof in any way. One should appreciate that the above-described features can be combined in any manner that makes technological sense, and that all such combinations are intended to be disclosed herein, regardless of whether such combinations are identified explicitly or not.

BRIEF DESCRIPTION OF THE DRAWING

The foregoing and other objects, features and advantages will be apparent from the following description of particular embodiments of the invention, as illustrated in the accompanying figures in which like reference characters refer to the same parts throughout the different views.

DETAILED DESCRIPTION

In the following discussion, numerous specific details are set forth to provide a through understanding of the present invention. However it will be obvious to those skilled in the art that the present invention may be practiced without such specific details.

Figure 1:
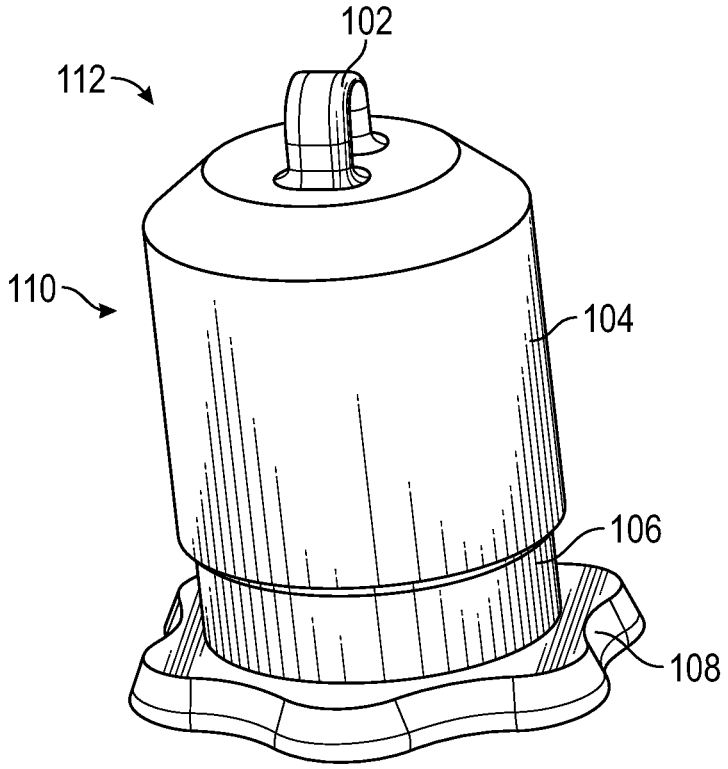
FIG. 1 illustrates a view of an example article holder apparatus according to the improved techniques.

In accordance with the improved techniques, and as described in further detail below, an example container for transport and storage of a bath sponge or other potentially wet article includes three sections. Included in the three sections is a top section, or sponge holding space 110, a middle section or separator 106, and a bottom or base 108. As exemplified in FIG. 1 of the drawings the three sections are assembled to create an enclosed unit.

Figure 2:
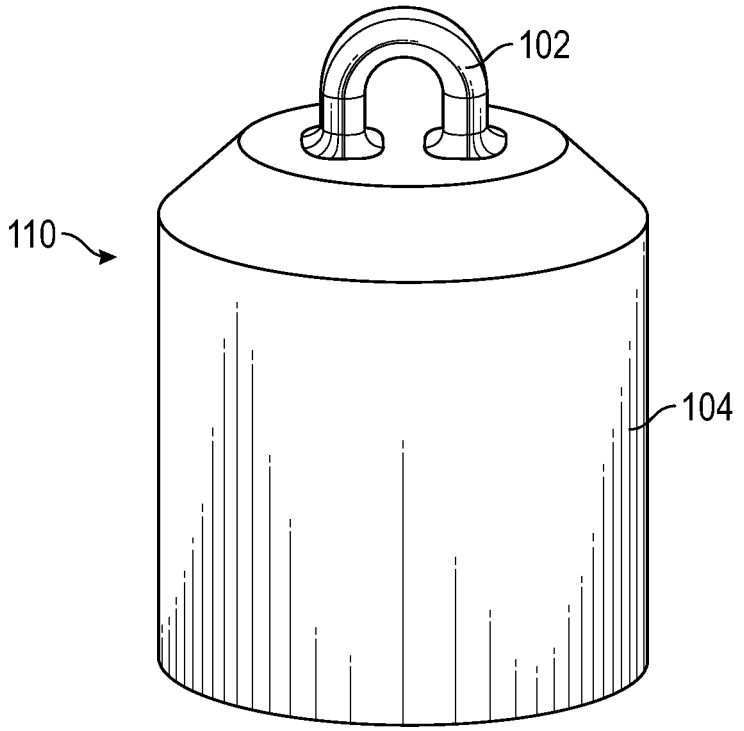
FIG. 2 illustrates a frontal view of the top housing section of the article holder apparatus.

As viewed in FIG. 2, the top section 110 includes a housing unit 104 with the intended purpose of holding a bath sponge 1006. The shape of the housing 104 will allow a bath sponge to be compressed. The act of compression allows water and debris to be expelled from the bath sponge. The housing 104 also aids in the maintenance of the bath sponge form and/or original shape by the act of continuous compression of the bath sponge as it is being stored in the housing 104.

Figure 3:
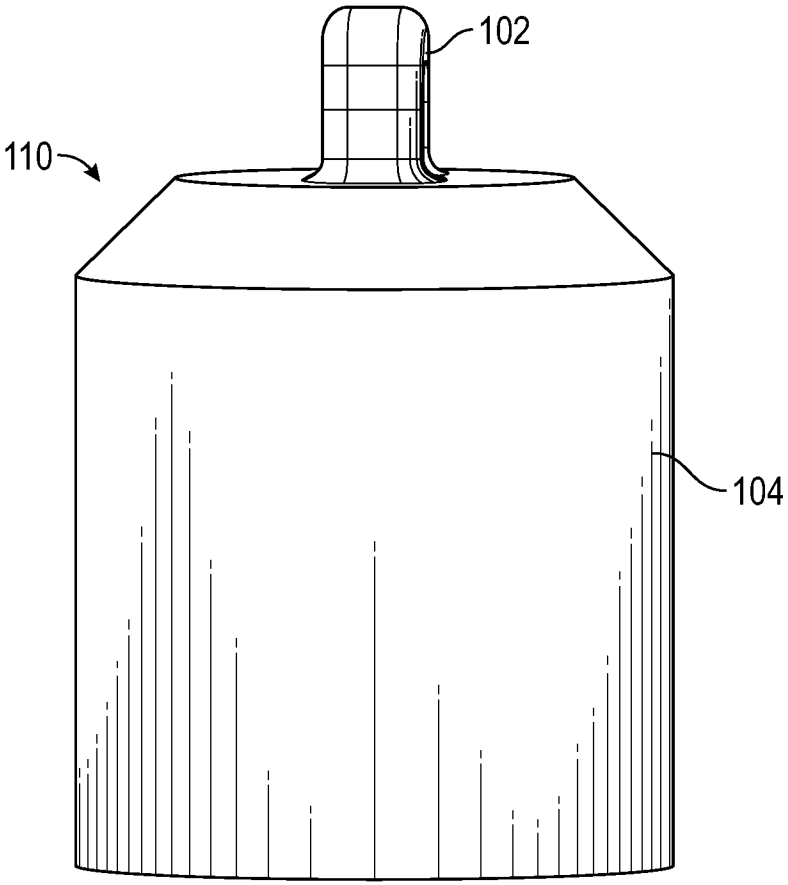
FIG. 3 illustrates a lateral/side view of the top housing section of the article holder apparatus.

Referring to FIG. 3, the sponge holding space 110 of the present invention has an appendage extending from the top of sponge holding space 110. The appendage has a hollow loop assembly 102 with an intended purpose of hanging the present invention on a peg or holder in a shower and or bathtub area. This aforementioned hanging loop 102 can also be used to hang a completely assembled unit 112 to any type of bag.

Figure 4:
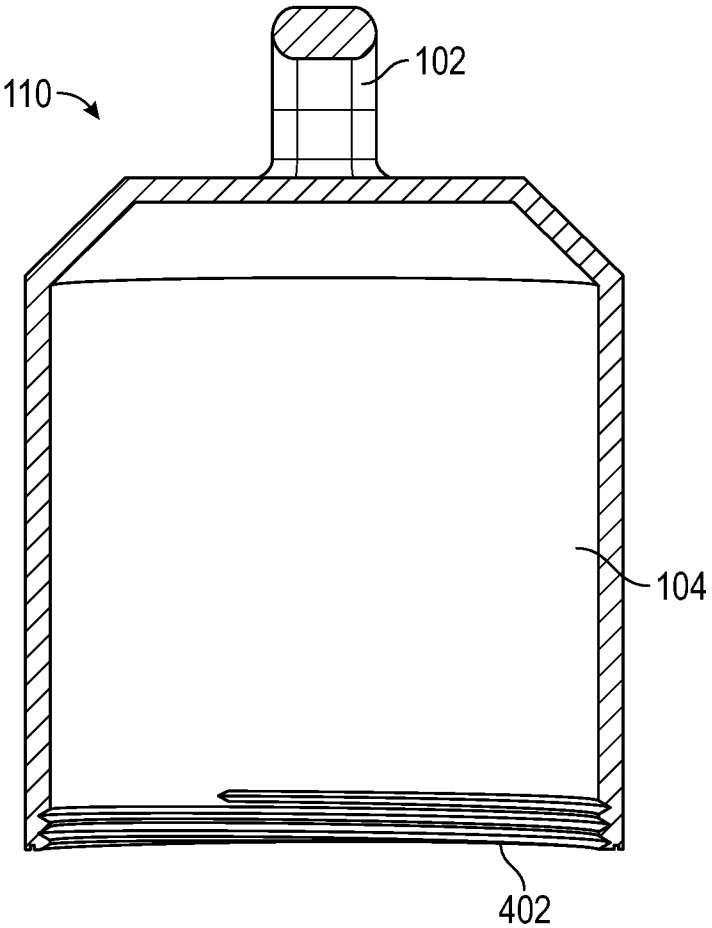
FIG. 4 illustrates a cross-sectional view of the top housing section of the article holder apparatus.

FIG. 4 illustrates a cross-sectional view of the top section shows the interior of the housing 104. The purpose of this housing section is to hold, contain, compress, and or store a bath sponge.

FIG. 4 also illustrates the attachment threads 402. The attachment threads facilitate the attachment of the top section 110 to the separator 106. Other attachment schemes may be used, such as various push-and-twist mechanisms, snapping mechanisms, and the like.

Figure 5:
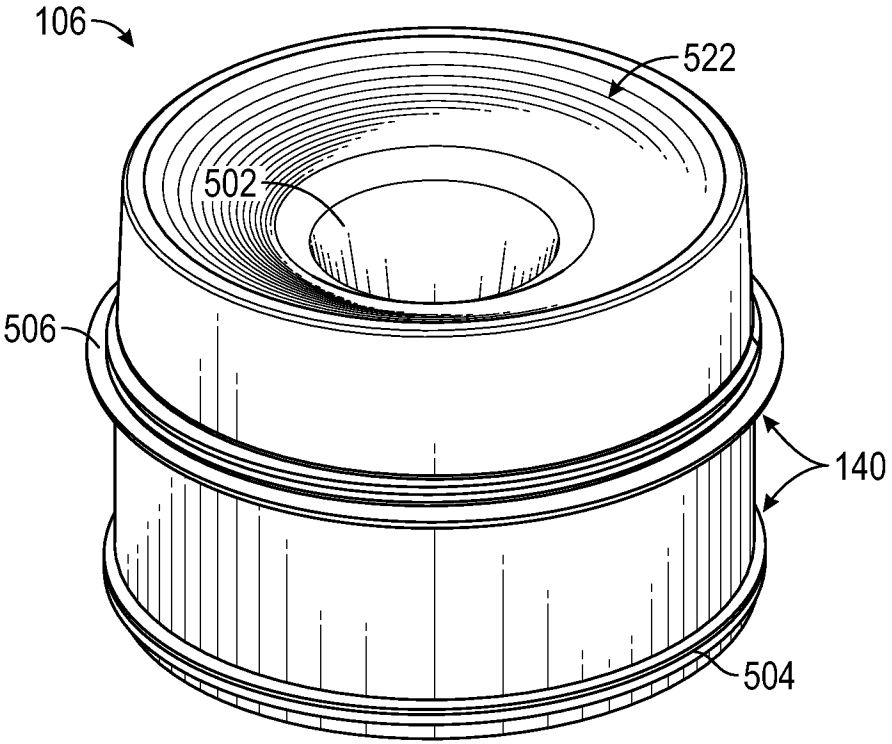
FIG. 5 illustrates a view of the middle section of the article holder apparatus.

FIG. 5 illustrates a view of the separator 106. The purpose of this section is to provide additional compression of the bath sponge by the action of driving the separator 106 into the top section 110. In additional the separator 106 has a funnel design 502 to facilitate the drainage of the by-product of water and debris which is a result of the additional compression of a used bath sponge. The water and debris that is expelled from the bath sponge as it is being compressed by the separator 106 will be diverted into the drainage funnel 502. The housing attachment threads 506 will facilitate the attachment of the separator 106 to the top section 110 by creating a screw together action to join the tops section 110 to the separator 106. The base attachment threads 504 are located at the bottom of the separator 106. These threads 504 facilitate attachment to the base 108. Other attachment schemes may be used, however, such as various push-and-twist mechanisms, snapping mechanisms, and the like.

Figure 6:
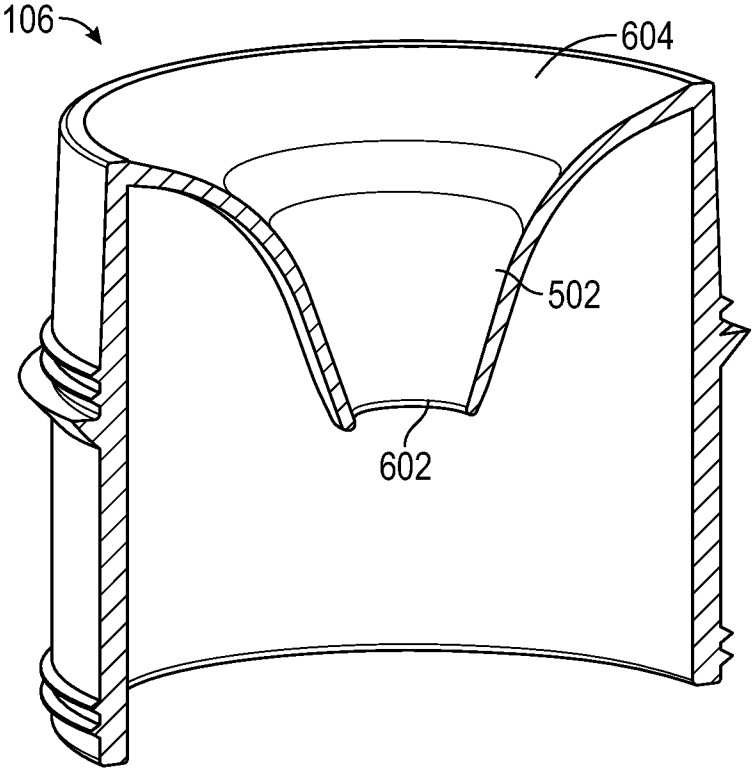
FIG. 6 illustrates a cross-sectional view of the middle section of the article holder apparatus.

FIG. 6 illustrates a cross-sectional view of the separator 106. This view best shows the drainage funnel 502 and the opening of the drainage funnel 602. As aforementioned, the byproduct of the act of compression of a used bath sponge is water and debris. This water and debris will be expelled through the opening in the drainage funnel 602. The water and debris can be held in a fully assembled bath sponge container 112 while being transported or the water and debris can be allowed to drain into a sink or tub while the top section 110 is being suspended by the hanging loop 102. In addition the top section 110 can be attached to the separator 106 to provide additional compression of a used bath sponge and water and debris can be allowed to drain into a sink or tub.

Figure 7:
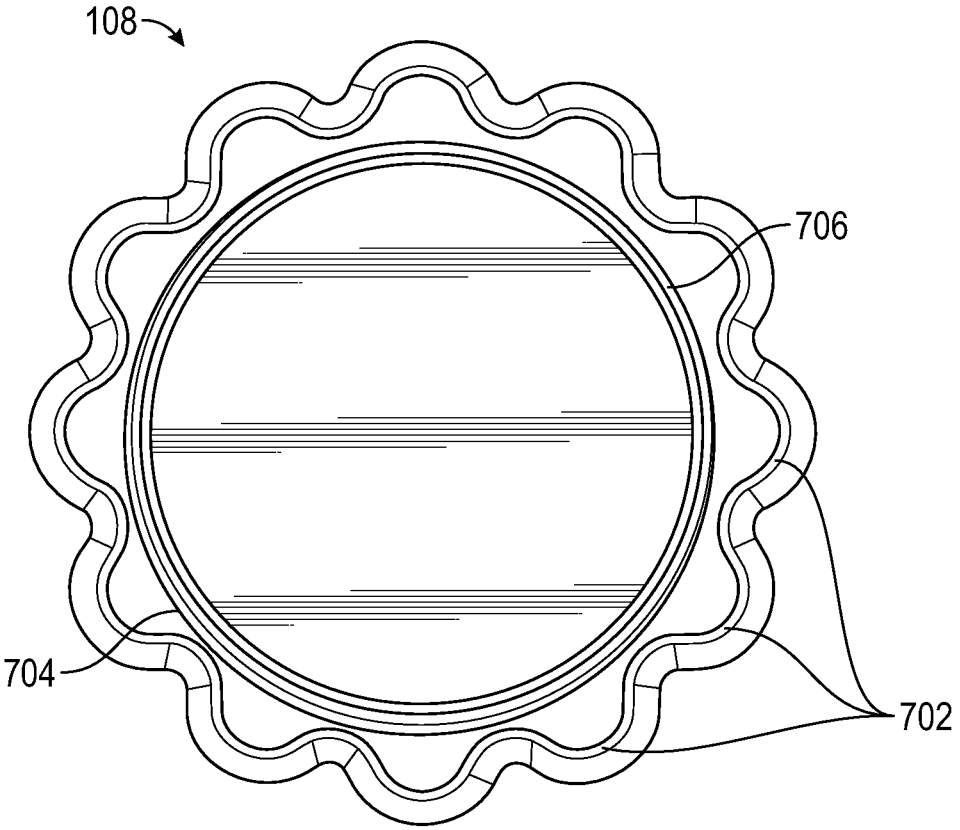
FIG. 7 illustrates a top view of the bottom section of the article holder apparatus.

FIG. 7 illustrates a top view of the base 108. The base 108 serves two purposes. The base 108 will allow a fully assembled bath sponge container 112 to stand independently on any smooth surface. In addition, the base 108 will serve as a reservoir for any water or debris that has been drained by the act of compressing a used bath sponge when the bath sponge container 112 is in an upright position.

As illustrated in FIG. 7, the base 108 has several bump out sections or gripping lobes 702. The purpose of the gripping lobes 702 is to provide a more secure grip on the base 108 when assembling or disassembling the bath sponge container 112.

FIG. 7 also illustrates a thin circular gasket 704. The purpose of the gasket 704 is to prevent leakage of water from the bath sponge container 112.

Figure 8:
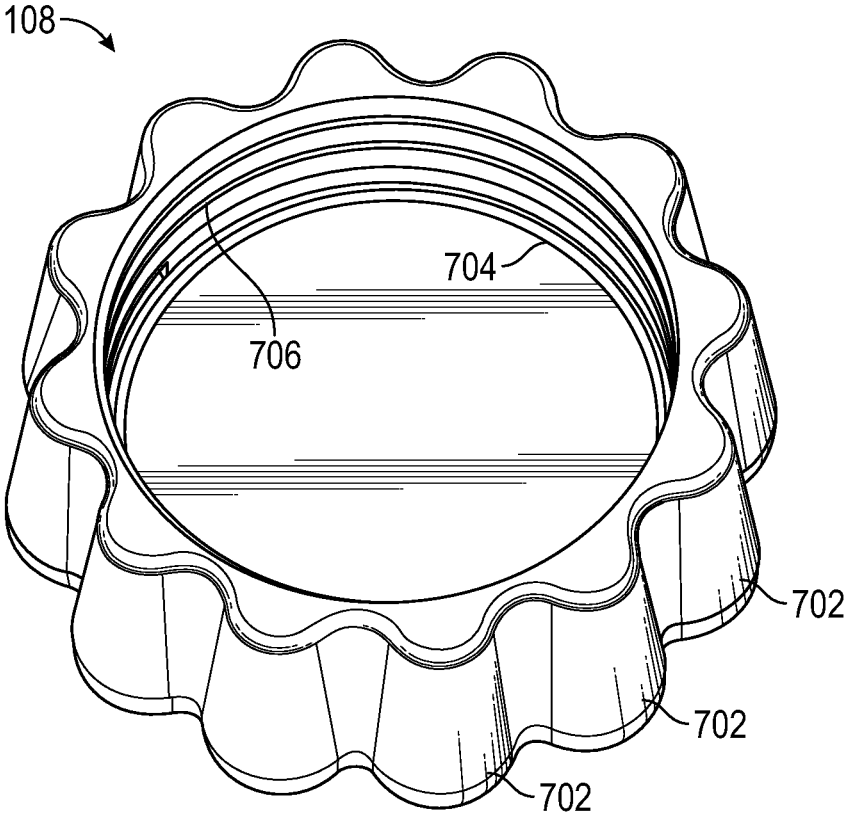
FIG. 8 illustrates an angled view of the bottom section.

FIG. 8 illustrates an additional view of the base 108 in which base attachment threads 802 may be seen. The base attachment threads 802 facilitate attachment of the base 108 to the middle section 508, which will create a fully assembled bath sponge container 112.

Figure 9:
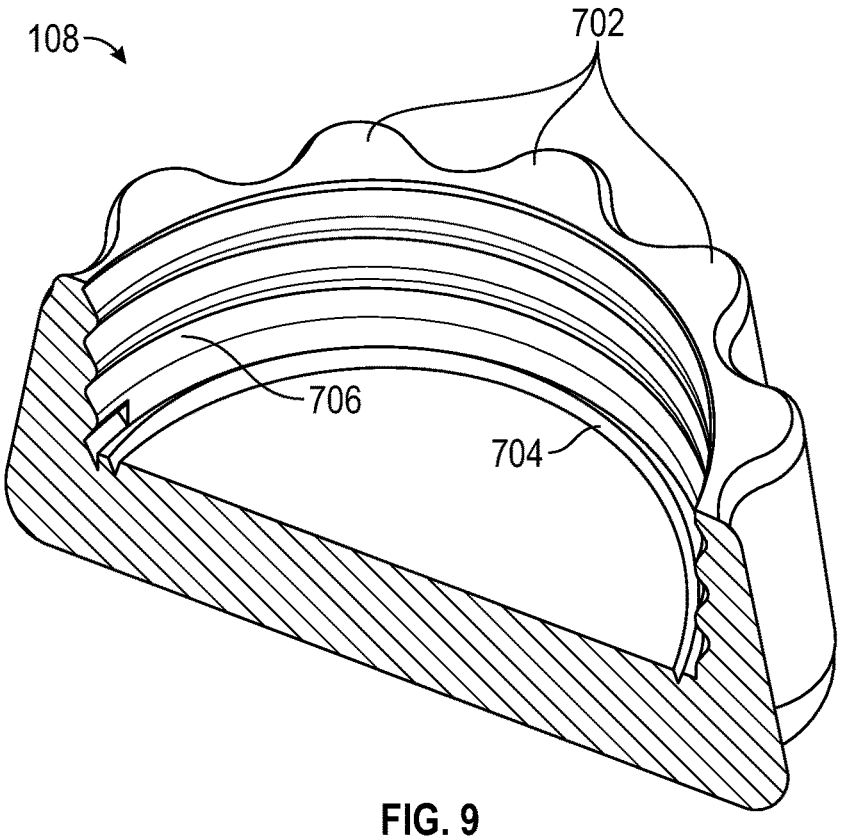
FIG. 9 illustrates a cross-sectional view of the bottom section.

FIG. 9 illustrates a cross-sectional view of the base 108. The placement of the gasket 704 can be seen as being recessed into a grooved well along the entire internal diameter of the base 108. The gasket 704 is recessed within this groove in the base 108.

Figure 10:
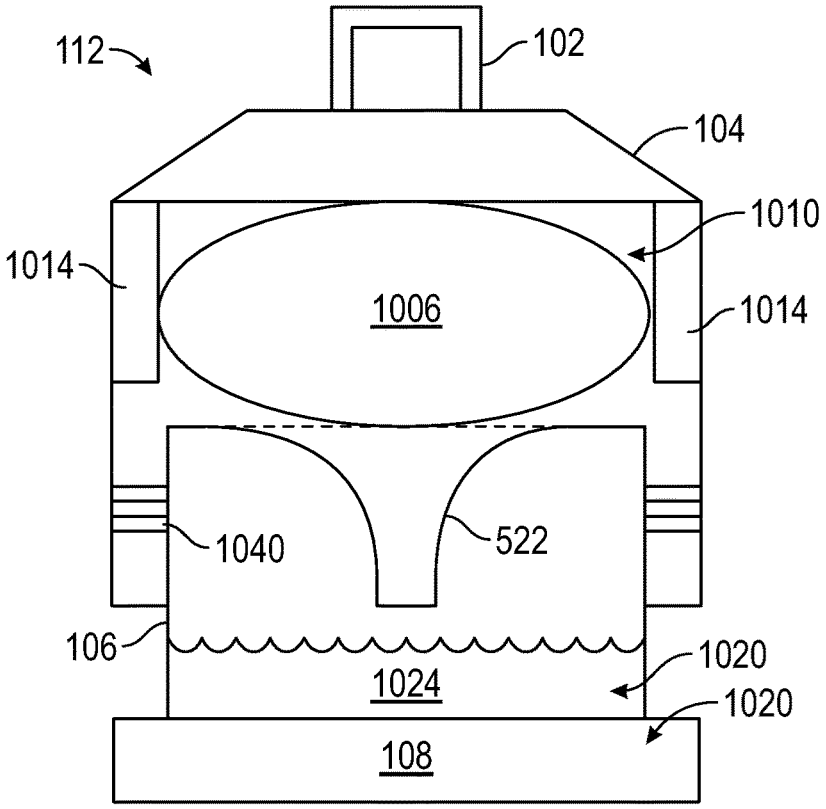
FIG. 10 is a block diagram illustrating a cross-sectional view of an assembled article holder apparatus.

FIG. 10 illustrates a cross-sectional view of a fully assembled bath sponge container 112. FIG. 10 illustrates a fully assembled bath sponge container 112. It also demonstrates the utility of the improved techniques, which is to contain, compress, drain, and transport a bath sponge 1006. The bath sponge container 112 includes a sponge holding space 1010 and the separator 106. The separator 106 separates the sponge holding space 1010 from a sponge draining space 1020.

The base 108 is attached to the separator 106. The attachment is facilitated by screwing together the base 108 to the separator 106 using the base attachment threads 504 (FIG. 5) and the separator attachment threads 706 (FIG. 7). The separator 106 is smaller in diameter than the top section 110, thus allowing the separator 106 to be driven up into the sponge holding space 1010. When the separator 106 is driven up as far as possible into the sponge holding space 1010, the separator 106 and the housing 104 can be attached, for example, by screwing together the attachment threads 402 (FIG. 4) and the housing attachment threads 506 (FIG. 5).

FIG. 10 illustrates the bath sponge 1006 as it is being compressed by the interior walls of the housing 1014, i.e. sponge holder 1014. The action of compression allows water and debris to be expelled from the bath sponge 1006. The water and debris, i.e., drainage 1024 is then diverted into the separator 106 and can be held in the fully assembled bath sponge container 112. The water and debris 1024 can be released from the bath sponge container 112 by unscrewing the base 108 from the separator 106 while holding over a sink or bath tub and allowing water and debris 1024 to drain.

Figure 11:
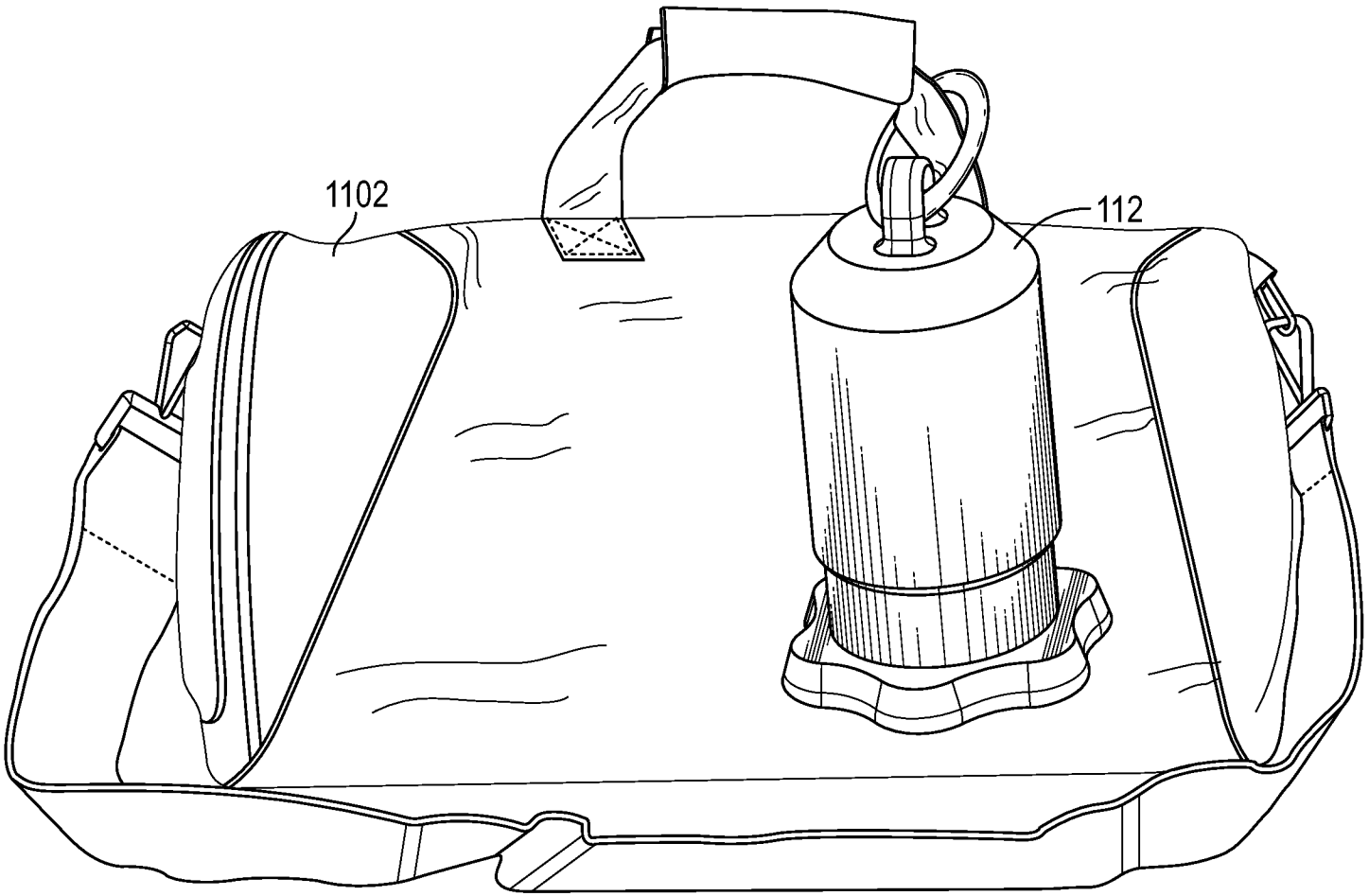
FIG. 11 illustrates a view of an assembled article holder apparatus as it hangs on a travel bag.

FIG. 11 illustrates an alternate embodiment of a fully assembled bath sponge container 112 hanging on a travel bag.

Figure 12:
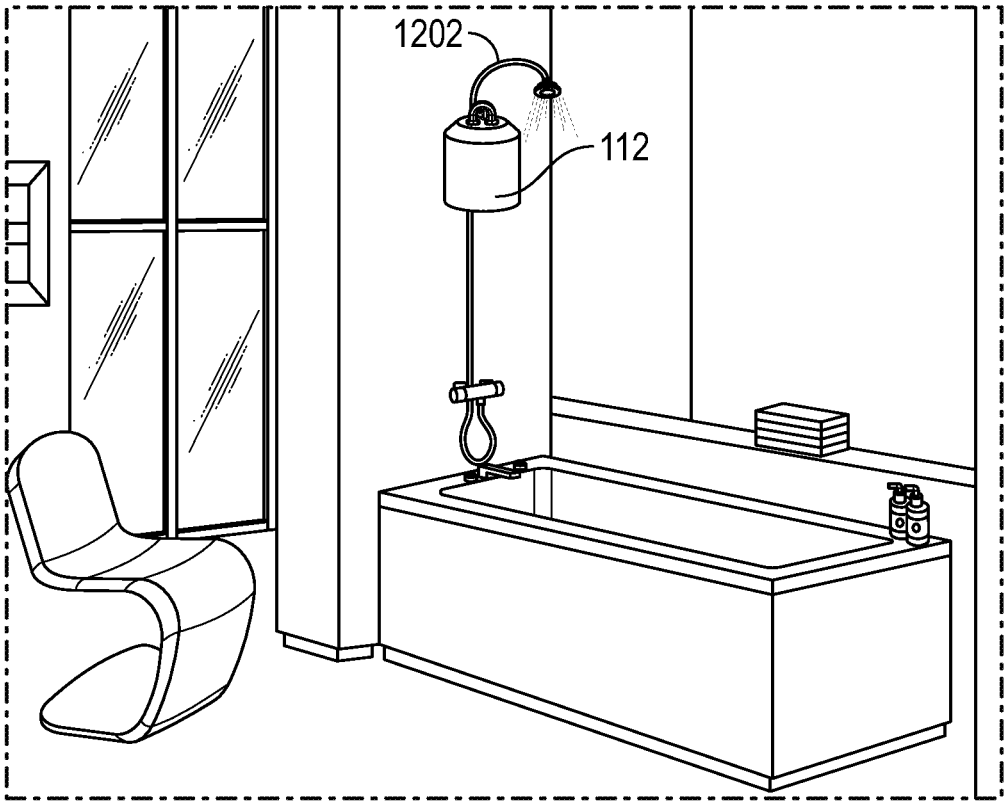
FIG. 12 illustrates a view of the top section of the article holder apparatus in an alternate embodiment as it hangs suspended by the hanging loop in a shower.

FIG. 12 illustrates an alternate embodiment of the bath sponge container as only the top section 110 is being suspended by the hanging loop 102 in a shower enclosure with a bath sponge 1006 being held and compressed by the housing 104.

Figure 13:
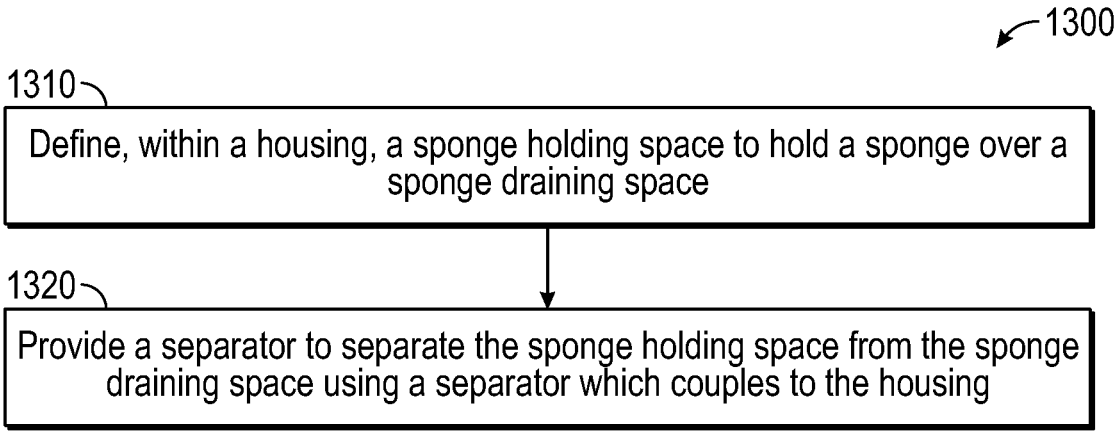
FIG. 13 is a flow chart illustrating an example method of manufacturing an article holding apparatus according to the improved techniques.
Figure 14:
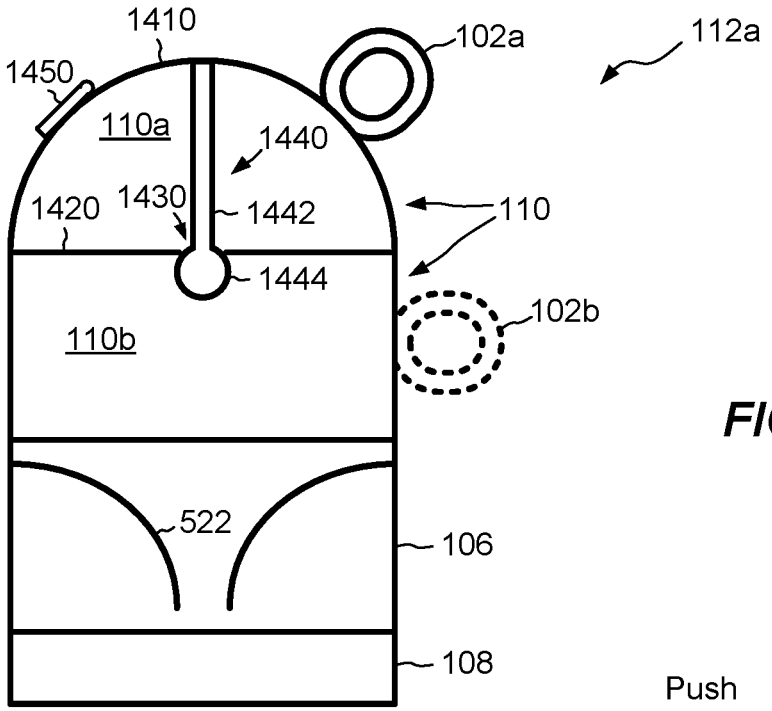
FIG. 14 is a cross-sectional view of an example alternative arrangement of an article holding apparatus that includes a liquid dispenser in a sealed condition in which it is arranged to contain liquid.

FIG. 13 illustrates an example method 1300 of manufacturing a sponge holding apparatus. At 1302, a sponge holding space is defined within a housing to hold a sponge over a sponge draining space. At 1304, a separator is provided to separate the sponge holding space from the sponge draining space using a separator which couples to the housing.

The aforementioned bath sponge container 112 may be fabricated from any number of different plastics, metals, composites, and the like, and any combinations thereof, depending upon the requirements of particular applications of the invention. Materials employed in the fabrication of the bath sponge container 112 are preferably suitable for exposure to water, but if materials are employed which are affected by water, such as wood, certain metals (e.g., iron, aluminum, brass), and the like, then a conventional protective coating is preferably applied to the surface of the material to protect it from water.

It is understood that the present invention may take many forms and embodiments. Accordingly several variations may be made in the foregoing without departing from the spirit or scope of the invention. For example a variety of sizes—smaller or larger than those illustrated in the Figures—could be fabricated to accommodate the storage, compression and drainage of any number of sponges for home, commercial, and personal use. In additional the present invention could be fabricated to accommodate any number of wet articles of clothing that require transportation, such as bathing suit, swim suits, and wet suits.

As an additional example, the number of petals in the gripping lobes 702 of the base 108 as illustrated in FIGS. 7-9 is 12, which is preferred. However, there may be any number of petals in the gripping lobes 702, e.g., 4, 5, 6, 7, 8, 9, 10, 11, 12, and higher.

As a further example, the separator 106 as illustrated in the Figures does not have a gasket; only the base 108 has a gasket. However, in some arrangements, the separator may have a gasket to further prevent fluids from escaping the container 112.

Liquid Dispenser:

FIGS. 14-18 show various views of an alternative article holder 112*a* which is adapted to include a dispenser of liquid. Like the article container 112, described above, the article holder 112*a* includes a top section 110, a middle section 106, and a bottom (base) section 108, where the top section 110 is attached to the middle section 106 and the middle section 106 is attached to the bottom section 108. Also, the middle section 106 and the bottom section 108 may be realized substantially as described above. Here, however, the top section 110 includes two distinct regions: a dispensing region (or simply, a "dispenser") 110*a* and an article-holding region 110*b*. The dispenser 110*a* has a top surface 1410 and a bottom surface 1420. The top surface 1410 is deformable and may be pushed down relative to the bottom surface 1420. The bottom surface 1420 forms a boundary that separates the dispenser 110*a* from the article-holding region 110*b*. For example, the bottom surface 1420 may be formed as a floor of the dispenser 110*a* or as a ceiling of the article-holding region 110*b*. By pressing down on the top surface 1410, a passageway is opened between the dispenser 110*a* and the article-holding region 110*b*, which allows liquid to flow from the dispenser 110*a* to the article-holding region 110*b*.

For example, the bottom surface 1420 has a clearance hole 1430, which may be located centrally within the bottom surface 1420. A plunger 1440 extends down from the top surface 1410. For example, the plunger 1440 may be formed integrally with the top surface 1410 or may be attached thereto in any suitable manner. The plunger 1440 has a shaft 1442, which passes down and through the clearance hole 1430 and terminates in a head 1444 on a far side of (below) the bottom surface 1420. In an example, the top surface 1410, which is preferably dome-shaped, exerts an upward force on the plunger 1440, pulling the plunger 1440 up so that the head 1444 presses against the clearance hole 1430 and effectively seals the clearance hole 1430 from the bottom, preventing liquid from leaking from the dispenser 110*a* into the article-holding region 110*b*.

The dispenser 110*a* thus forms a normally-closed container for containing liquid, such as liquid soap, bath wash, lotion, shampoo, or the like. The article holder 112*a* may include a hanging loop 102*a*, which extends outwardly from the top section 110. In some examples, the hanging loop 102*a* is displaced from at top center of the top section 110, to better enable a human user to push down on (or pump) the top surface 1410 for dispensing liquid. For example, the hanging loop 102*a* may be placed off to the side of the top surface 1410 (shown in solid lines), or on a side wall of the article-holding region 110*b* (shown in dashed lines).

In some examples, the top surface 1410 has a closable aperture 1450. A user may open the aperture 1450 to introduce liquid and may close the aperture 150 to operate the dispenser. Alternatively, the user may introduce liquid by other means, such as through the clearance hole 1430.

Figure 15:
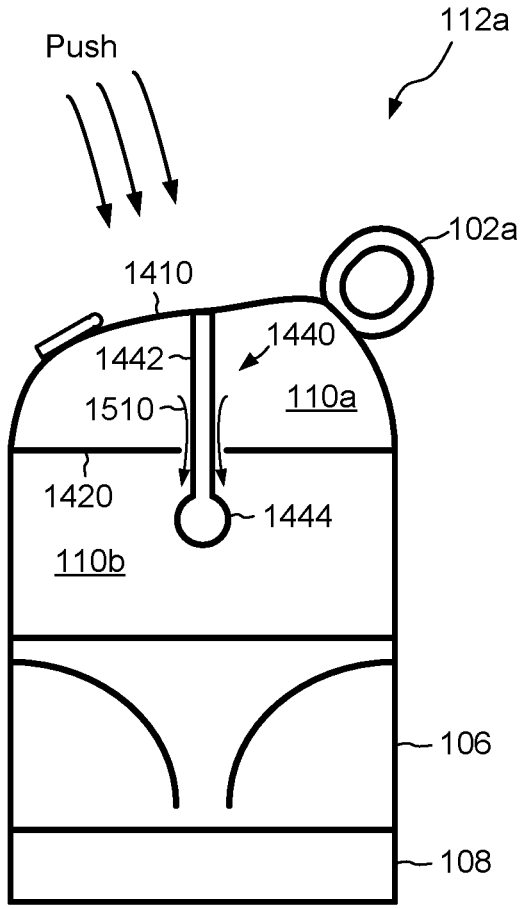
FIG. 15 is a cross-sectional view of the article holding apparatus of FIG. 14 in a dispensing condition in which it is arranged to dispense liquid.

FIG. 15 shows the article holder 112*a* with the dispenser 110*a* being actuated, e.g., with the dispenser 110*a* operated by a user pushing down on the top surface 1410. As shown, pushing down on the top surface 1410 overcomes the biasing force that normally keeps the plunger closed and has the effect of moving the plunger 1440 down, so that the head 1444 of the plunger 1440 no longer seals the clearance hole 1430. As the clearance hole 1430 has a diameter larger than that of the shaft 1442 (but smaller than that of the head 1444), pushing down on the plunger 1440 opens a space around the shaft 1442 and allows liquid to flow (see arrows 1510) from the dispenser 110*a*, through the clearance hole 1430, and into the article-holding region 110*b*. As the dispenser 110*a* normally forms a sealed container, pushing down on the top surface 1410 has the effect not only of opening the clearance hole 1430, but also of applying pressure that tends to force liquid through the clearance hole 1430.

Figure 16:
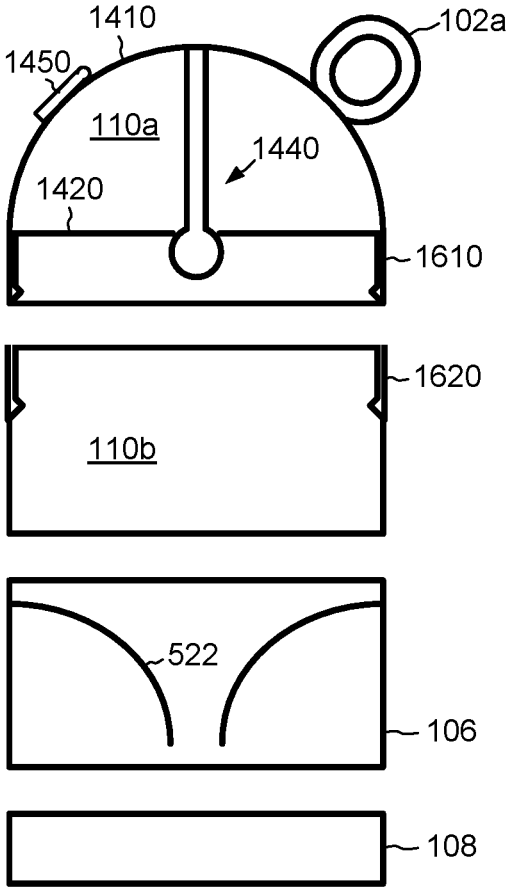
FIG. 16 is a partially exploded view of the article holding apparatus of FIGS. 14 and 15.

FIG. 16 shows an exploded view of the article holding apparatus 112*a*. Here, the dispenser 110*a* and the article-holding region 110*b* may be provided as separate components that attach together. As a non-limiting example, the dispenser 110*a* may include a lip 1610 that extends down from the bottom surface 1420. The lip 1610 may be arranged to engage a channel 1620, which may be formed in walls of the article-holding region 110*b*. Although shown as extending down on left and right sides, the lip 1610 may extend around a circumference of the dispenser 110*b*, e.g., all the way around the bottom of the dispenser 110*b*.

In some examples, the dispenser 110*a* is a molded or partially molded unit. Different parts of the dispenser 110*a* may be composed of different materials. For instance, the bottom surface 1420 may be composed of a more rigid material than is the top surface 110*a*. For example, the top surface 1410 may be composed of a flexible silicone material, while the bottom surface 1420 may be composed of a more rigid silicone material or of some other material.

Figure 17:
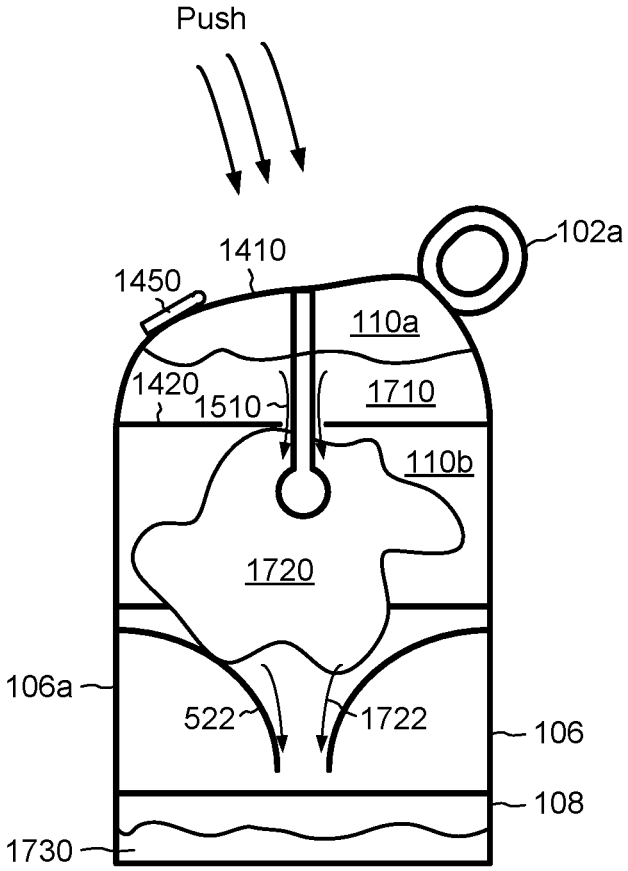
FIG. 17 is a cross-sectional view of the article holding apparatus of FIGS. 14-16, shown in an operating condition.

FIG. 17 shows the article holding apparatus 112*a* in an operating condition. Here, liquid 1710 has been introduced into the dispenser 110*a*, and a wet article 1720 (bath sponge, bathing suit, etc.) has been placed in the article-holding region 110*b*. When the top section 110 and the middle section 106 are attached together, the wet article 1720 becomes compressed, such that it releases fluid 1730, which passes through the funnel 522 (arrows 1722) and into the bottom section 108, where the fluid 1730 collects. As before, the funnel 522 has a larger opening at the top than at the bottom, and extends inwardly from sidewalls 106*a* and downwardly toward the bottom section 108.

If the user wishes to dispense liquid 1710, the user may press down on the top surface 1410 of the dispenser 110*a*, which causes the head 1444 of the plunger 1440 to move downwardly away from the clearance hole 1430 and to allow liquid 1710 to flow from the dispenser 110*a* into the article-holding region 110*b*. When the user releases pressure from the top surface 1410, the top surface 1410 pops back up, returning to its dome-shaped form. The user may pump the top surface 1410 in this fashion repeatedly, to dispense any desired quantity of liquid 1710.

Figure 18:
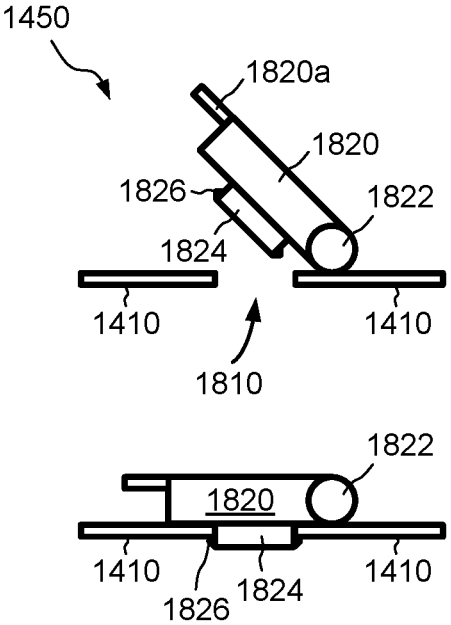
FIG. 18 is a side view of a closable aperture, in both an open condition (top of figure) and in a closed condition (bottom of figure).

FIG. 18 shows the closable aperture 1450 in additional detail, illustrating both an open condition (top) and a closed condition (bottom). In an example, the closable aperture 1450 includes a through-hole 1810 and a door 1820 that rotates on a hinge 1822, which is formed between the door 1820 and the top surface 1410 of the dispenser 110*b*. A cylindrical projection 1824 extends from the door 1820 and snaps into the hole 1810 in the top surface 1410. For example, the cylindrical projection 1824 may have raised regions 1826 that resist opening of the door 1820 and assist in forming a positive seal when closing the door 1820. In some examples, the door 1820 has a tab 1820*a* that a user can grasp to assist in opening the door 1820.

Having thus described the present invention by reference to certain of its preferred embodiments, it is noted that the embodiments disclosed are illustrative rather than limiting in nature and that a wide range of variations, modifications, changes and substitutions are contemplated in the foregoing disclosure and, in some instances, some features of the present invention may be employed without corresponding use of the other features. Many such variations and modifications may be considered obvious and desirable by those skilled in the art based upon review of the foregoing description of preferred embodiments. Accordingly, it is appropriate that the appended claims be constructed broadly and in a manner consistent with the scope of the invention.

Further, although features are shown and described with reference to particular embodiments hereof, such features may be included and hereby are included in any of the disclosed embodiments and their variants. Thus, it is understood that features disclosed in connection with any embodiment are included as variants of any other embodiment.

As used throughout this document, the words "comprising," "including," and "having" are intended to set forth certain items, steps, elements, or aspects of something in an open-ended fashion. Also, as used herein and unless a specific statement is made to the contrary, the word "set" means one or more of something. This is the case regardless of whether the phrase "set of" is followed by a singular or plural object and regardless of whether it is conjugated with a singular or plural verb. Although certain embodiments are disclosed herein, it is understood that these are provided by way of example only and the invention is not limited to these particular embodiments.

Those skilled in the art will therefore understand that various changes in form and detail may be made to the embodiments disclosed herein without departing from the scope of the invention.

What is claimed is:

1. A method of containing a wet article, the method comprising:

attaching a top section of a case to a middle section of the case with the wet article placed between the top section and the middle section, such that the wet article is compressed between the top section and the middle section when the top section and the middle section are attached together; and draining fluid from the wet article through a funnel in the middle section of the case and into a bottom section of the case, the funnel extending inwardly from an external sidewall of the middle section and downwardly toward the bottom section.

2. The method of claim 1, wherein the top section includes a dispenser region and an article holding region, the dispenser region having a depressible top, and wherein the method further comprises:

containing a volume of liquid in the dispenser region, the dispenser region forming a normally-closed compartment for containing the volume of liquid; and in response to the depressible top of the dispenser region being pressed down, opening a passageway between the dispenser region and the article-holding region, the passageway enabling at least some of the liquid to flow from the dispenser region to the article-holding region.

3. The method of claim 2, wherein the dispenser region has a top surface and a bottom surface, the top surface being deformable, the top surface being coupled to or integral with a plunger having a shaft, the shaft extending down from the top surface and passing through a clearance hole in the bottom surface, the shaft having a head formed on a far side of the bottom surface, opposite the top surface, the head normally biased against the clearance hole to hold the clearance hole closed, and wherein opening the passageway includes, in response to pressing down on the depressible top, moving the head down from the clearance hole and proving a passageway for liquid to flow from the dispenser region into the article-holding region.

4. The method of claim 3, wherein the dispenser region includes a closable aperture having an open position and a closed position, and wherein the method further comprises:

with the closable aperture in the open position, receiving liquid into the dispenser region through the closable aperture, and with the closable aperture in the closed position, dispensing liquid from the dispenser region into the article-holding region while maintaining a liquid-tight closure of the closable aperture.

5. The method of claim 4, wherein the closable aperture includes a hinged door that is operable to alternately open and close the closable aperture, and wherein the method further comprises:

opening the hinged door prior to receiving liquid into the dispenser region; and closing the hinged door prior to dispensing liquid from the dispenser region.

6. An apparatus for containing a wet article, the apparatus comprising:

a top section;

a middle section removably attached to the top section; and a bottom section removably attached to the middle section, the top section including a dispenser and an article holding region, the dispenser forming a normally-closed compartment for holding liquid and having a depressible top, the top section configured, upon depression of the depressible top, to open a passageway between the dispenser and the article-holding region for allowing liquid to flow from the dispenser to the article-holding region, the middle section including a funnel having a wider opening facing the top section and a narrower opening facing the bottom section, the funnel configured to conduct fluid released from the wet article from the top section to the bottom section.

7. The apparatus of claim 6, wherein the dispenser has a top surface and a bottom surface, the top surface being deformable, the bottom surface forming a boundary that separates the dispenser from the article-holding region.

8. The apparatus of claim 7, wherein the bottom surface of the dispenser is formed from a more rigid material than is the top surface of the dispenser.

9. The apparatus of claim 8, wherein the dispenser includes a closable aperture operable between an open position and a closed position, the closable aperture formed within the top surface of the dispenser.

10. The apparatus of claim 9, wherein the closable aperture includes a hole in the top surface of the dispenser and a hinged door, the hinged door covering the hole in the top surface of the dispenser when closed, to form a liquid-tight seal with the top surface, and allowing an introduction of liquid into the dispenser when open.

11. The apparatus of claim 7, wherein the top surface is coupled to or integral with a plunger, the plunger having a shaft that extends down from the top surface and passes through a clearance hole in the bottom surface, the shaft forming a head on a far side of the bottom surface, the head of the plunger normally biased against the clearance hole to hold the clearance hole closed, the shaft being moveable in a downward direction within the clearance hole, in response to downward pressure applied to the top surface, to provide a passageway for liquid to flow from the dispenser, through the clearance hole, and into the article-holding region.

12. The apparatus of claim 11, wherein the dispenser, including the top surface, the bottom surface, and the plunger, is provided as a first component, wherein the article-holding region is provided as a second component, and wherein the first component is attached to the second component to form the top section of the apparatus.

13. The apparatus of claim 7, further comprising a hanging loop coupled to or integral with the top surface of the dispenser and extending outwardly from the apparatus.

14. The apparatus of claim 7, further comprising a hanging loop coupled to or integral with the article-holding region and extending outwardly from the apparatus.

15. The method of claim 1, wherein the top section includes a dispenser region and an article holding region, and wherein the method further comprises dispensing liquid from the dispensing region into the article holding region.

16. The method of claim 15, wherein dispensing the liquid includes dispensing at least one of (i) liquid soap, (ii) bath wash, (iii) or shampoo.

* * * * *